United States Patent [19]

Murphy

[11] 4,085,474

[45] Apr. 25, 1978

[54] APPARATUS FOR INTERIORLY CLEANING LENGTHS OF PIPE

[76] Inventor: Herbert R. Murphy, 3067 E. 1st St., Long Beach, Calif. 90803

[21] Appl. No.: 716,885

[22] Filed: Aug. 23, 1976

[51] Int. Cl.[2] ..... B08B 9/02

[52] U.S. Cl. ..... 15/104.1 R; 15/268; 134/167 C

[58] Field of Search ..... 15/88, 104.1, 104.12, 15/104.13, 104.14, 304, 306, 316, 268; 134/132, 134, 82, 83, 167 C

[56] References Cited

U.S. PATENT DOCUMENTS

| | | | |
|---|---|---|---|
| 572,740 | 12/1896 | Black | 15/104.12 X |
| 836,629 | 11/1906 | Casaday | 15/104.13 |
| 949,622 | 2/1910 | Cragin | 15/104.1 R X |
| 2,549,659 | 4/1951 | Brendel | 15/104.1 R X |
| 2,674,760 | 4/1954 | Finch | 15/304 |
| 3,400,419 | 9/1968 | Fuller | 15/104.1 R |

*Primary Examiner*—Christopher K. Moore
*Attorney, Agent, or Firm*—Fulwider, Patton, Rieber, Lee & Utecht

[57] ABSTRACT

Apparatus for cleaning scale, sludge, rust, concrete, or other unwanted material from the interior walls of sections of pipe, the apparatus including a honing tool which is insertable and rotatable in a section of pipe clamped on a transportable primary carrier, and has at its end a cutting tool with a pair of arcuate cutting edges to provide a desirable tangential contact with the pipe, and to facilitate cleaning of slightly bent pipes. The tool also has two pairs of diametrically opposed cutting elements resiliently mounted on the tool shank and urged outwardly in a self-centering action. The tool is mounted on a shaft which is loosely journaled on a secondary carrier, to provide tool flexibility and a desirable whipping action, and the secondary carrier can be telescoped into the primary carrier for transportation purposes. A hydraulic motor for driving the tool shaft is mounted on a carriage which can be translated linearly on the secondary carrier, to advance the tool into the clamped pipe section. The primary carrier also includes hydraulic mechanisms for loading, clamping and unloading sections of pipe.

7 Claims, 20 Drawing Figures

APPARATUS FOR INTERIORLY CLEANING LENGTHS OF PIPE

BACKGROUND OF THE INVENTION

This invention relates generally to apparatus for cleaning rust, sludge, hardened concrete, and other unwanted materials from the interior surfaces of pipes. More particularly, the invention relates to apparatus of this type which is transportable to a field location where sections of pipe are to be cleaned.

In many industrial applications, but particularly in the drilling and production of oil, interconnected sections of metal pipe are used for the transportation of various materials. In oil drilling, pipes often serve multiple purposes, such as carrying water or other lubricant to the drilling face, carrying oil from the drill hole, or carrying concrete which is pumped down the pipe for various purposes. In such environments, the interior walls of the pipe inevitably become encrusted with rust, sludge, or hardened concrete. Moreover, some paraffin-base oils leave a waxy coating on the pipe. Since most chemical cleaners which will dissolve or remove the unwanted material from the pipe are also harmful to the metallic pipe material, mechanical cleaning methods are usually preferred. Typically, pipe-cleaning machines of the prior art have required that a section of pipe be rotated on its longitudinal axis, and advanced over a cutting tool of some kind. Machines of this general type are inherently unsafe to operate, because of the long rotating sections of pipe, and are often unable to handle even slightly bent pipes. Attempts to clean bent pipes using machines of the prior art often resulted in removal of pipe material as well as the unwanted material from inside the pipe. Consequently, machines of this type often also include a pipe-straightening device.

It will be apparent from the foregoing that there is a definite need for an improved pipe-cleaning machine which can be operated with relative safety, which is transportable for use in the field, and which can handle slightly bent sections of pipe without removal of pipe material or pre-straightening of the pipe. The present invention fulfills this need.

SUMMARY OF THE INVENTION

The present invention overcomes many of the disadvantages of prior art pipe-cleaning machines by providing an elongated honing tool which is insertable and rotatable in a section of pipe to be cleaned, thereby avoiding the necessity of rotating the pipe itself. Moreover, the rotating tool is enclosed by the pipe section, and the apparatus can therefore be used with a high degree of safety.

In brief, the honing tool of the invention includes a relatively rigid shank having a driven end and a free end. On the free end is secured a double-edge cutting element having arcuate, diametrically opposed cutting edges. Since the cutting edges have no sharp corners and always contact the interior pipe surface tangentially, the tool can easily negotiate slight bends in the pipe without serious difficulty. Also included is at least one pair of trailing cutting elements, spaced along the shank from the first cutting element, the pair of elements being diametrically opposed and urged outwardly from the shank in a self-centering action. Preferably, and as in the illustrative embodiment to be described herein, there is also a second pair of cutting elements, also diametrically opposed to each other, disposed approximately 90° in relation to the first pair, and also urged outwardly from the shank to provide a self-centering action in two orthogonally related axes. The apparatus of the invention also includes means for rotating the shank and for advancing the tool through the section of pipe to be cleaned.

More specifically, the cutting element on the free end of the shank is a relatively flat, spade-shaped element mounted diametrically on the shank, and having a pointed leading edge and two arcuate diametrically opposed side edges. The pairs of trailing cutting elements are, in the presently preferred embodiment, mounted on leaf springs which urge them outwardly from longitudinal slots in the shank. Each of these trailing cutting elements is cylindrical in shape and is secured to a mounting block having an arcuate outer face, the mounting block being secured, in turn, to one of the leaf springs. The annular cutting element may, as in a presently preferred embodiment, be rotatably mounted in its mounting block, to provide a self-sharpening action.

To facilitate removal of the unwanted material from the interior of the pipe, liquid may be pumped through a central passage in the shank of the tool, and onto the interior pipe surface through appropriate ports in the shank surface. The liquid is also supplied through radial passages to the longitudinal slots in which the pairs of trailing cutting elements are mounted, to ensure that the cutting elements are free to move in their mountings, unhindered by any material which might otherwise accumulate in the longitudinal slots.

In accordance with another aspect of the invention, the tool is mounted on a shaft which is relatively loosely journaled to provide a desirable slight whipping action at the free end of the shank. This feature also allows the tool to negotiate slight bends more easily, which it could not do if it were constrained by bearings having relatively close tolerances.

In the preferred embodiment of the invention, the pipe sections to be cleaned are secured one at a time in a structure referred to herein as a primary carrier. The primary carrier takes the form of a trailer vehicle which may be towed by a truck. A secondary carrier supports and advances the tool shaft, and is designed to be telescoped into the primary carrier for purposes of transportation. When extended, the secondary carrier supports a carriage on which is mounted hydraulic drive means for the shaft. The secondary carrier also supports a plurality of shaft bearings and a second drive means for advancing the carriage longitudinally along the secondary carrier toward the primary carrier. As the carriage is advanced, the tool and shaft are advanced with it into a pipe section secured on the primary carrier, and the shaft bearings are gathered together toward the primary carrier. When the carriage is driven in the opposite direction to remove the tool from the pipe section, the pipe bearings are again spaced apart along the secondary carrier to support the full length of the shaft.

Further features of the invention are hydraulic means for loading sections of pipe beside the primary carrier, hydraulic means for clamping a section of pipe to be cleaned, and hydraulic means for unloading a section of pipe from the primary carrier and placing it on a stack of cleaned pipe sections.

Other aspects and advantages of the invention will become apparent from the following detailed description taken in conjunction with the accompanying drawings.

DETAILED DESCRIPTION

Figure 1:
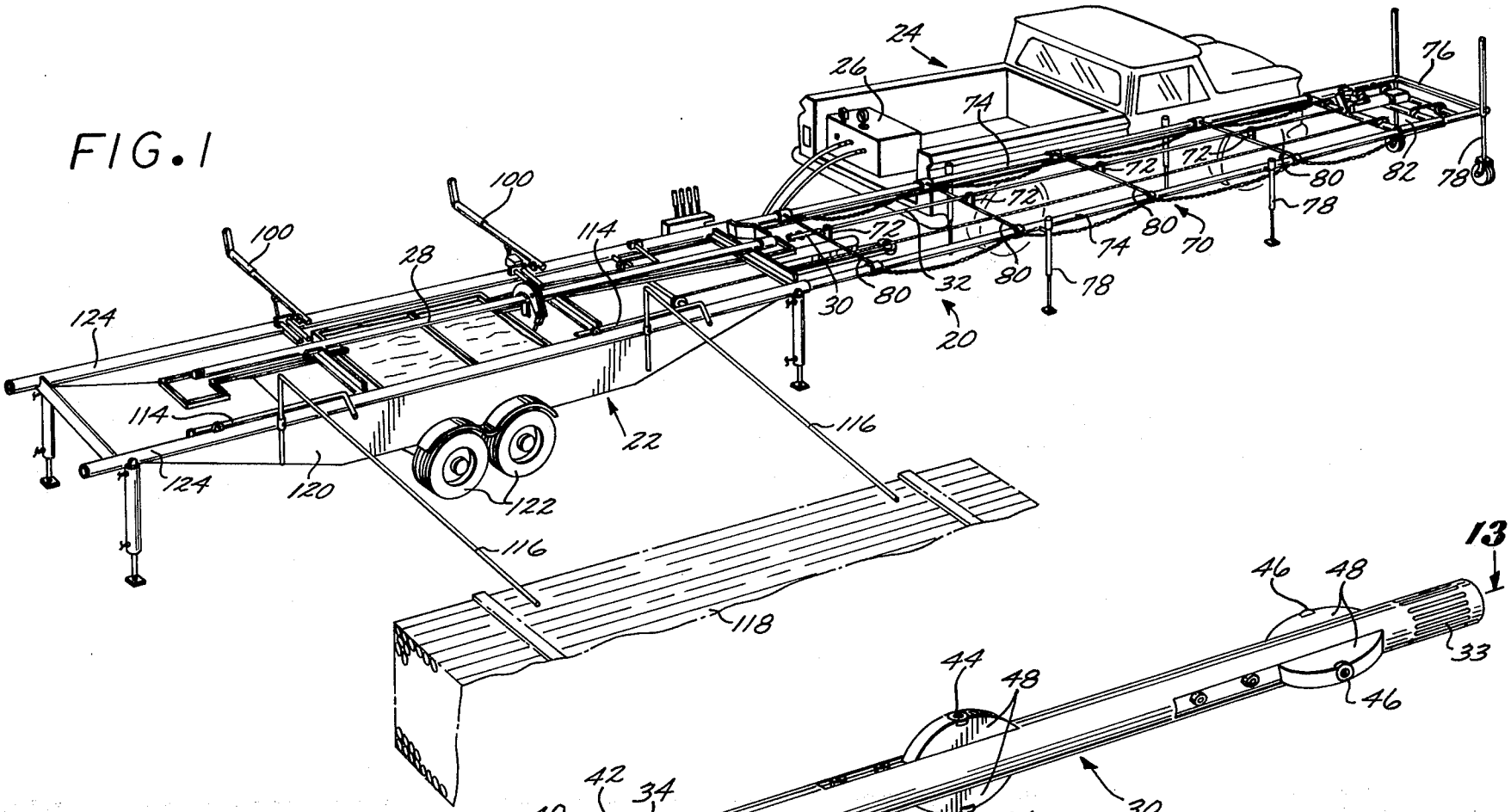
FIG. 1 is a perspective view of pipe-cleaning apparatus embodying the present invention, also showing a vehicle for towing the apparatus and providing necessary hydraulic power.

As shown in the drawings for purposes of illustration, the present invention is embodied in apparatus, indicated generally by reference numeral 20 in FIG. 1, for interiorly cleaning sections of pipe such as might be used in oil production work. In use, such pipes can become coated with rust, sludge, wax from paraffin-base crude oils, hardened concrete, and other unwanted materials, and it is usually desirable that they be cleaned in the field by some mechanical means, rather than with a chemical cleaner which might harm the pipe material itself. Accordingly, the pipe-cleaning apparatus 20 can be mounted for transportation on a trailer 22, referred to herein as the primary carrier, the trailer being towable by a truck 24 or other vehicle, which may also be used to provide hydraulic power by means of a suitable hydraulic power unit, indicated at 26. Transportable pipe-cleaning machines of this general type have, in the past, required the rotation of a pipe section to be cleaned. Consequently, they were relatively unsafe to operate and could not handle even slightly bent pipes without removing some of the pipe material.

Figure 2:
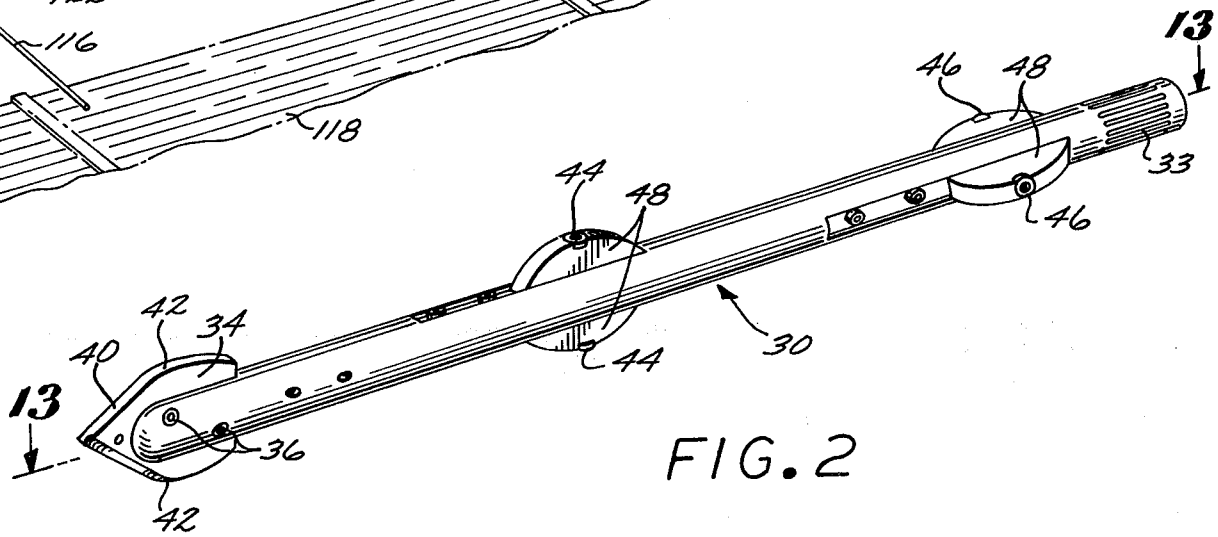
FIG. 2 is a perspective view of the honing tool used in the present invention.

In accordance with the present invention, a pipe section 28 to be cleaned is clamped securely in the primary carrier 22, and a honing tool 30, best shown in FIG. 2, is mounted for rotation on a shaft 32 and is advanced into the pipe section 28. The only exposed rotating member is the shaft 32, which can be suitably shrouded if desired. Since the pipe section 28 is held stationary, and since the rotating tool 30 is inside the pipe, the apparatus 20 provides a high degree of safety of operation. Moreover, it is faster and quieter than other apparatus previously available for cleaning pipes.

More specifically, the tool 30 comprises a shank 33, mounted as an extension of the shaft 32, and a double edge cutting element 34 secured to the free end of the shank. The cutting element 34 is substantially flat and is secured by set screws 36 in a diametric slot 38 of substantial length in the end of the shank 33. The cutting element 34 has a pointed leading edge 40, and has arcuate, diametrically opposed side cutting edges 42. The pointed leading edge 40 facilitates cutting into massive obstructions in the pipe section 28, while the arcuate cutting edges 42 provide for tangential contact with the interior walls of the pipe, thereby ensuring that only a negligible amount of material will be removed from the pipe itself. Moreover, the arcuate cutting edges 42 facilitate use of the tool 30 in pipe sections having slight bends, without necessitating straightening of the pipe before it is cleaned.

Also secured to the shank 33, at a substantial distance from the cutting element 34, are a pair of diametrically opposed cutting elements 44, and, spaced further along the shank is another pair of cutting elements 46 also secured to the shank of the tool, but diametrically opposed at approximately 90° in relation to the first pair of cutting elements 44. As best shown in FIGS. 13-16, each of the cutting elements 44 and 46 is mouned in a mounting block 48 having the approximate shape of a segment of a circle, as viewed perpendicularly to the shank 33 and to the diametric spacing of the pairs of cutting elements. Each of the mounting blocks 48 is secured to a leaf spring 50 of approximately the same width as the thickness of the mounting block. The leaf springs 50 are, in turn, secured to the shank 33 in such a manner that the mounting blocks are partially engaged in longitudinal slots 52 in the shank. The diametric spacing of the pairs of cutting elements 46 and 48 is arranged to be slightly greater than the internal diameter of the pipe section 28 to be cleaned, so that the cutting elements are urged outwardly against the interior walls of the pipe by the leaf springs 50. Since the leaf springs 50 are of substantially equal resilient strength, the cutting elements 46 and 48 also function to center the shank 33 in the pipe section 28.

Figures 13, 13A, 14, 15, 16, 17, 18, 19:
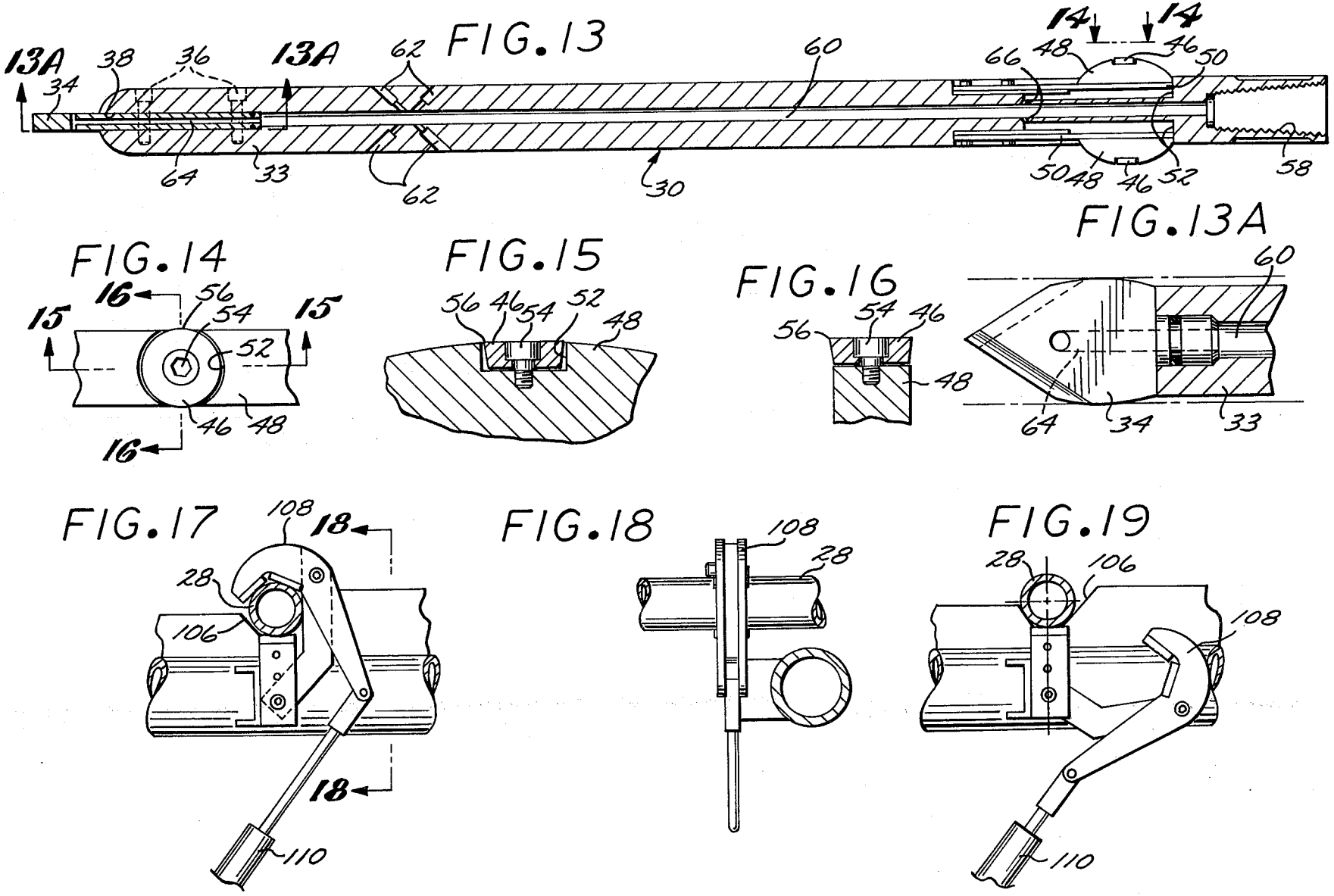
FIG. 13 is an enlarged longitudinal sectional view of the tool shown in FIG. 2, taken substantially along the line 13—13 of FIG. 2.
FIG. 13A is a fragmentary, partly sectional view of the tool, taken substantially along the line 13A—13A of FIG. 13.
FIG. 14 is a plan view of one of the trailing cutting elements taken substantially along the line 14—14 of FIG. 13.
FIG. 15 is a sectional view of the cutting element of FIG. 14 taken substantially along the line 15—15 of FIG. 14.
FIG. 16 is a sectional view of the cutting element of FIG. 14 taken substantially along the line 16—16 of FIG. 14.
FIG. 17 is an enlarged, fragmentary view of a hydraulic mechanism used in the apparatus of FIG. 1 for securing a section of pipe to the primary carrier.
FIG. 18 is sectional view of the hydraulic mechanism of FIG. 17 taken substantially along the line 18—18 of FIG. 17.
FIG. 19 is a view similar to FIG. 17, but showing the hydraulic mechanism in a released position.

As can be seen in FIGS. 15 and 16 each of the cutting elements 44 and 46 is essentially cylindrical, and is secured in a recess 52 in the mounting block 48 by a set screw 54 through the center of the cutting element. The cutting elements 44 and 46 are slightly tapered, so that the outer peripheral cutting edge 56 has a slightly larger diameter than the opposite, inner circular edge secured in the recess 52. Preferably, the cutting elements 44 and 46 are free to rotate on the set screws 54, so that different portions of the cutting edge 56 will be used in the honing process, thereby providing a self-sharpening action for the cutting elements.

The tool shank 33 includes some form of threaded coupling 58 (FIG. 13) for attachment to the shaft 32 (FIG. 1), and also has a central bore 60 through which water or some other lubricant is provided to facilitate the cleaning process. Communicating with the bore 60 are a plurality of passages 62 which provide a supply of water to the exterior of the tool shank 33. The bore 60 also communicates with a passage 64 in the forward cutting tool 34, and from there provides water through ports in the side faces of the cutting tool 34. The bore 60 also communicates through small passages 66 to the longitudinal slots 52 in which the pair of cutting elements 46 are mounted. Other passages (not shown) also communicate with the corresponding longitudinal slots in which the other pair of cutting elements 44 are mounted. Water supplied to the slots 52 prevent the build-up of unwanted material under the mounting blocks 48, and thereby allow free radial movement of the pairs of cutting elements 44 and 46 in their mountings.

In accordance with another aspect of the invention, the shaft 32 on which the tool 30 is mounted is rotatably supported in a secondary carrier 70 (FIG. 1) by means of a plurality of bearings 72, the tolerances of which provide for substantial clearance between the shaft outside diameter and the bearing inside diameters. This provides the shaft 32 and attached tool 30 with a desired degree of flexibility, and induces a slight degree of whipping of the tool 30 as it rotates in the pipe section 28. Moreover, the flexibility of the shaft 32 facilitates cleaning of slightly bent pipe sections.

Figure 8:
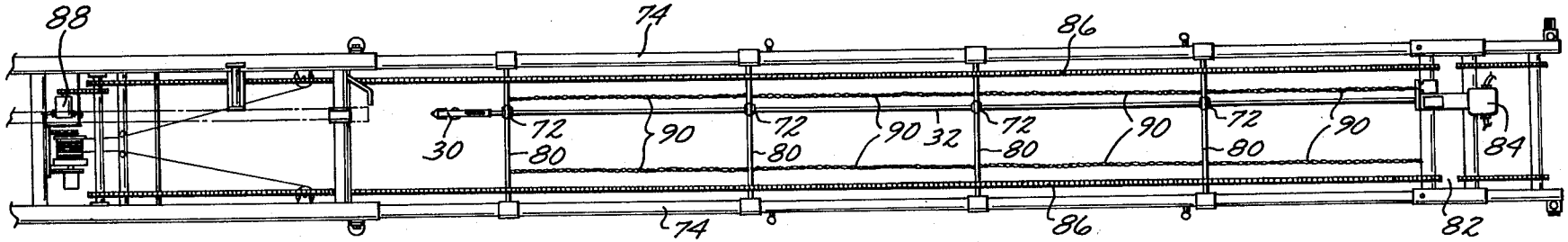
FIG. 8 is a fragmentary plan view of the secondary carrier of the apparatus of FIG. 1, showing the shaft bearings in spaced relationship and the tool fully withdrawn from a pipe section.
Figure 9:
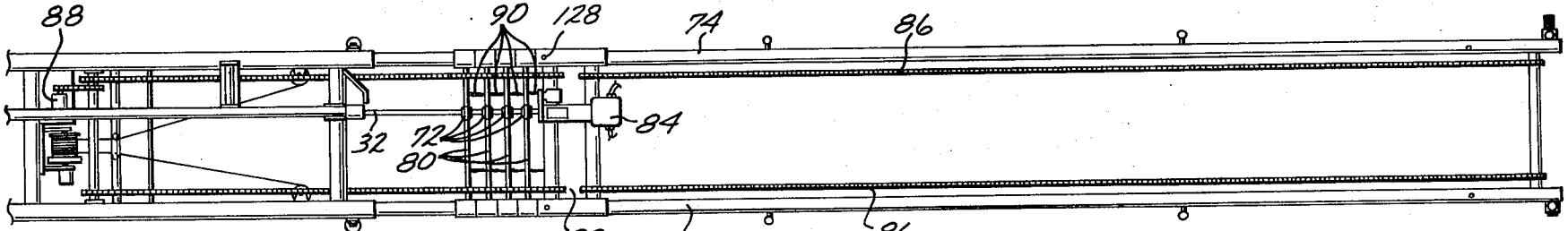
FIG. 9 is a plan view similar to FIG. 8, but showing the tool fully engaged in a pipe section and the shaft bearings in a gathered relationship.

As can be seen from FIG. 1, the secondary carrier 70 forms an extension of the primary carrier 22, and, as will be further explained, may be telescoped into the primary carrier for purposes of transportation. The secondary carrier 70 basically comprises a pair of longitudinal support rails 74 combined with various cross members, one of which is shown at 76, to form a rigid structure supported above ground level on jacks 78. Each of the shaft bearings 72 is carried on a transverse supporting member 80, which, in turn, is slidably mounted by its ends on the longitudinal rails 74. As best shown in FIGS. 8 and 9, the bearings 72 may be spaced relatively widely apart along the rails 74, as shown in FIG. 8, or may be gathered together on the rails as shown in FIG. 9.

Also mounted for sliding movement on the rails 74 is a carriage 82 on which is mounted a hydraulic motor 84 for rotating the shaft 32. The carriage 82 is translated along the rails 74 by means of a pair of chains 86 driven through appropriate gearing by another hydraulic motor 88, mounted on the primary carrier 22. The transverse members 80 on which the bearings 72 are supported are connected by chains 90 of equal length between adjacent ones of the members. The chains 90 ensure that the bearings 72 are uniformly spaced apart when the carriage 82 is at the right-hand end of the rails 74 and the tool 30 is fully retracted from the pipe section 28.

In operation, the tool 30 is rotated by the hydraulic motor 84, and the carriage 82 is advanced to the left, as viewed in the drawings, moving the tool into the pipe section 28. As the carriage 82 moves to the left, the bearings 72 supporting the shaft 32 are gathered or bunched together until they reach the configuration shown in FIG. 9. When the tool 30 is removed from the pipe section 28 by translating the carriage 82 back towards the right, as viewed in the drawings, the bearings 72 supporting the shaft 32 are again spaced apart uniformly as shown in FIG. 8.

Figure 4:
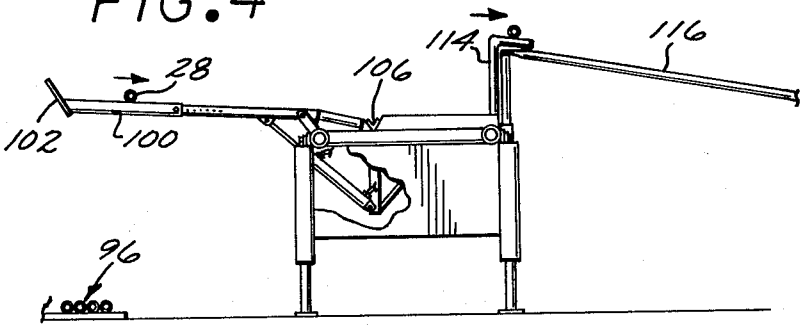
FIG. 4 is a view similar to FIG. 3, showing in particular the pipe loading operation.
Figure 3:
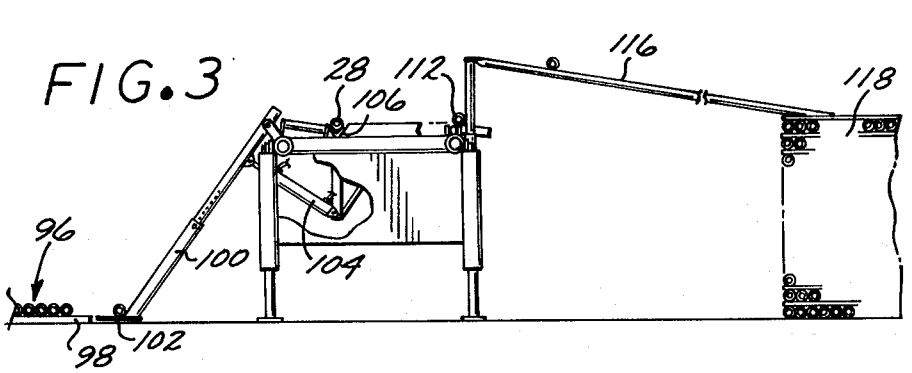
FIG. 3 is an end-elevational view of the primary carrier of the apparatus of FIG. 1, showing the pipe loading and unloading operations.

The presently preferred embodiment of the invention also includes means for loading, securing, and unloading the sections of pipe 28 to be cleaned. As shown in FIG. 3, the pipes to be loaded for cleaning, indicated at 96 are assumed to be stacked on a loading platform 98. The apparatus of the invention includes a pair of loading arms 100, which may be adjusted in length, and which may assume the position shown in FIG. 3, extending down from the primary carrier 22 to pick up one of the pipes 96. Each loading arm 100 includes a toe 102 onto which a new section of pipe to be cleaned may be placed by an operator. The loading arms 100 are pivoted on the primary carrier 22 by means of an actuating cylinder, shown at 104 in FIG. 3. The arms 100 pivot upwardly until a position just above horizontal is reached, as shown in FIG. 4, whereupon the section of pipe 28 will be rolled from the loading arms and into a V-slot 106 defining a cleaning station in which it is to be clamped for cleaning.

As shown in FIGS. 17–19, the pipe section 28 is held in the V-slot 106 by means of a clamp 108 hydraulically actuated by a hydraulic cylinder 110, using conventional mechanical linkages. The clamp 108 is lifted upwardly and away from the pipe section 28 on actuation of the hydraulic cylinder 110, to release the pipe section.

After cleaning, each pipe section 28 is rolled away from the V-slot 106 to the position shown at 112 in FIG. 3. From there, a pair of pivoted unloading arms 114 (FIG. 1) are used to lift the pipe section to a pair of sloping rails 116, down which the pipe section is rolled to a stack of cleaned pipes, indicated at 118.

Figure 12:
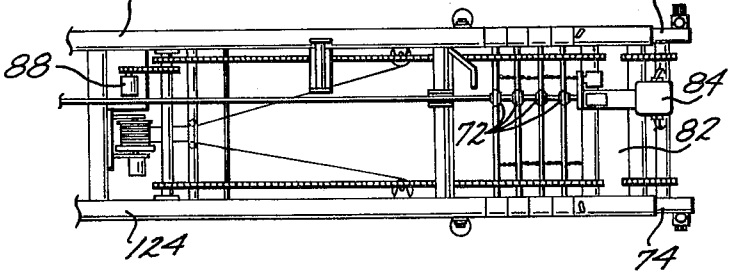
FIG. 12 is a fragmentary plan view of the apparatus, showing the secondary carrier telescoped into the primary carrier.
Figure 11:
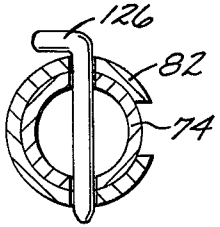
FIG. 11 is an enlarged sectional view taken substantially along the line 11—11 of FIG. 10, and showing a locking pin used to secure a slidable carriage to the secondary carrier.
Figure 10:
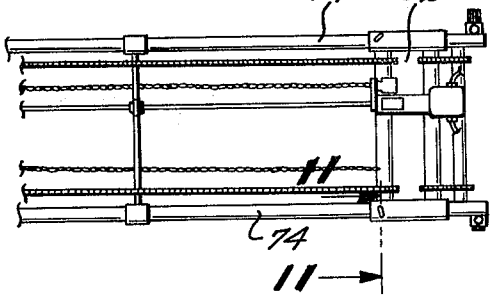
FIG. 10 is a fragmentary plan view of one end of the secondary carrier shown in FIG. 8.

As already mentioned, the secondary carrier 70 of the apparatus is, in accordance with another aspect of the invention, capable of being telescoped into the primary carrier 22 for transportation purposes. Basically, the primary carrier 22 consists of a rigid frame 120 supported on wheels 122, and having two longitudinal tube elements 124 along its sides. The tubes 124 are larger in diameter than the rails 74 on the secondary carrier 70. When the jacks 78 are removed from the secondary carrier, the rails 74 may be telescoped into the tubes 124 to reach the configuration shown in FIG. 12. To retract the secondary carrier 70 into the primary carrier 22, the carriage 82 is locked to one of the rails 74 by means of a locking pin 126, shown in FIG. 11. With the carriage 82 locked in this manner, activation of the drive motor 88 will translate the carriage 82, and together with it the entire secondary carrier 70, toward the primary carrier 22. It should be noted that the secondary carrier can be held in its fully extended position by means of a similar locking pin indicated at 128 in FIG. 9.

Figure 5:
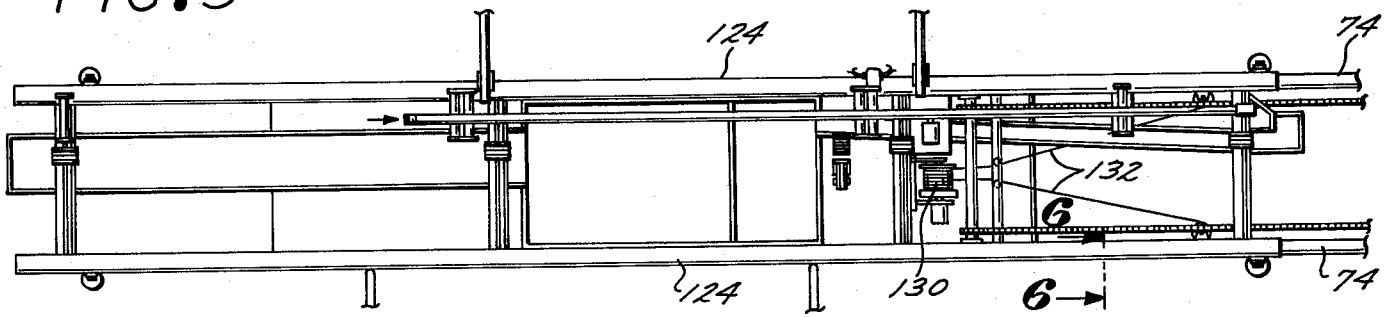
FIG. 5 is a fragmentary plan view of the apparatus of FIG. 1.
Figure 7:
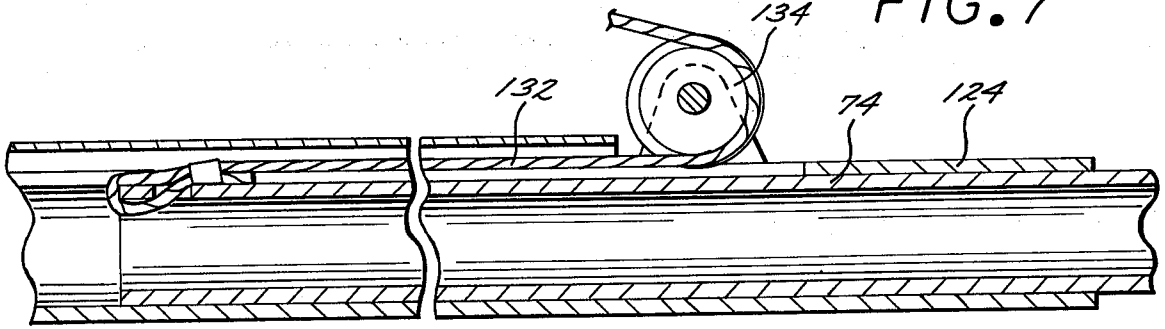
FIG. 7 is a sectional view taken substantially along the line 7—7 of FIG. 6, and showing how the secondary carrier is extended from the primary carrier.
Figure 6:
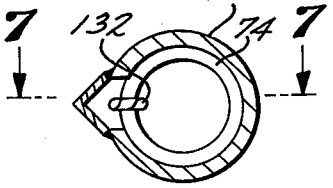
FIG. 6 is an enlarged sectional view taken substantially along the line 6—6 of FIG. 5, and showing the telescoping relationship of primary and secondary carriers.

FIGS. 5–7 illustrate how the secondary carrier 70 is removed or extended from the primary carrier 22. A winch 130 is used to pull a pair of cables 132, the ends of which are attached to the telescoped rails 74. The cables 32 pass over suitable pulleys 134 such that, when the winch is activated, the rails 74 are drawn from the tubes 124 of the primary carrier 22.

It will be appreciated from the foregoing that the present invention represents a significant advance in the field of pipe-cleaning devices. More particularly, the apparatus of the present invention provides a high degree of safety to its operators, and is faster and quieter than machines available heretofore for the same purpose. Moreover, the manner in which the rotatable shaft carrying the honing tool is journaled provides for a desirable whipping action in the tool, and facilitates cleaning of slightly bent pipes. The tool itself is self-centering and self-lubricating, and thoroughly cleans the interior surfaces of the pipe sections without removing pipe material.

It will also be apparent that, although a particular embodiment of the invention has been described in detail for purposes of illustration, various modifications may be made without departing from the spirit and scope of the invention. Accordingly, the invention is not to be limited except as by the appended claims.

What is claimed is:

1. Apparatus for interiorly cleaning lengths of pipe, said apparatus comprising;

an elongated primary carrier;

locating means on said primary carrier defining a cleaning station for receiving and orienting a length of pipe for cleaning;

clamping means for securing said length of pipe in said cleaning station;

an elongated secondary carrier located adjacent and in general longitudinal alignment with said primary carrier;

an elongated drive shaft;

a plurality of coupled bearing means longitudinally movable on and carried by said secondary carrier, and spaced along the length of and rotatably supporting said drive shaft adjacent said cleaning station;

a cutting tool mounted to said drive shaft;

drive means for rotating said shaft for rotating said cutting tool;

a carriage on said secondary carrier supporting said drive means and longitudinally movable on said secondary carrier in one direction for moving said cutting tool inwardly of and along the length of said length of pipe for effecting longitudinal movement of said plurality of bearing means toward said cleaning station and closer to one another, said carriage being coupled to at least one of said plurality of bearing means and longitudinally movable in a direction opposite said one direction for moving said cutting tool outwardly of said length of pipe and for effecting longitudinal movement of said plurality of bearing means away from said cleaning station and farther from one another;

means on said primary carrier for receiving said secondary carrier in a retracted position with respect to said primary carrier;

means for moving said secondary carrier between said retracted position and an extended position; and means for locking said secondary carrier in said extended position.

2. Apparatus for interiorly cleaning lengths of pipe, said apparatus comprising:

an elongated primary carrier;

locating means on said primary carrier defining a cleaning station for receiving and orienting a length of pipe for cleaning;

clamping means for securing said length of pipe in said cleaning station;

an elongated secondary carrier located adjacent and in general longitudinal alignment with said primary carrier;

an elongated drive shaft;

a plurality of coupled bearing means longitudinally movable on and carried by said secondary carrier, and spaced along the length of and rotatably supporting said drive shaft adjacent said cleaning station;

a cutting tool mounted to said drive shaft;

drive means for rotating said shaft for rotating said cutting tool;

a carriage on said secondary carrier supporting said drive means and longitudinally movable on said secondary carrier in one direction for moving said cutting tool inwardly of and along the length of said length of pipe for effecting longitudinal movement of said plurality of bearing means toward said cleaning station and closer to one another, said carriage being coupled to at least one of said plurality of bearing means and longitudinally movable in a direction opposite said one direction for moving said cutting tool outwardly of said length of pipe and for effecting longitudinal movement of said plurality of bearing means away from said cleaning station and farther from one another;

means on said primary carrier for receiving said secondary carrier in a retracted position with respect to said primary carrier; and means for locking said carriage to said secondary carrier whereby movement of said carriage in said one direction is accompanied by movement of said secondary carrier toward said retracted position.

3. Apparatus a set forth in claim 1 wherein said means for moving said secondary carrier includes winch means, and further includes at least one cable coupled to said winch means and said secondary carrier and operative upon operation of said winch means to move said secondary carrier toward said extended position.

4. Apparatus for interiorly cleaning lengths of pipe, said apparatus comprising:

an elongated cutting tool movable along and rotatable within a length of pipe for cutting away unwanted material, said tool including a shank having a driven end and a free end; a leading cutting element secured to said free end and having arcuate cutting edges located on diametrically opposite sides of said shank for engaging the interior walls of the pipe; a pair of mounting blocks located on diametrically opposite sides of said shank in longitudinally spaced relation to said leading cutting element; a pair of trailing cutting elements carried by said mounting blocks, respectively; and resilient means securing said mounting blocks to said shank and operative to urge said cutting edges of said trailing cutting elements against the interior walls of the pipe; and means connected to said driven end of said shank for rotating and moving said cutting tool along the length of pipe to be cleaned.

5. Apparatus as set forth in claim 4 wherein said trailing cutting elements include circular cutting edges, and said trailing cutting elements are secured, respectively, within recesses provided in said mounting blocks, each of said circular cutting edges being located slightly above the adjacent surfaces of the associated one of said mounting blocks.

6. Apparatus as set forth in claim 4 wherein said trailing cutting elements include circular cutting edges and are rotatable relative to said mounting blocks to present different portions of said circular cutting edges to the interior walls of the pipe during rotation of said cutting tool within the pipe.

7. Apparatus as set forth in claim 4 wherein said shaft is sufficiently long that upon rotation thereof said shaft tends to flex laterally; said apparatus further including a plurality of longitudinally spaced apart bearings for rotatably supporting said shaft, the size of said bearings being such that said shaft is permitted to flex laterally to a limited extent while it is supported whereby said arcuate cutting edges of said leading cutting element are enabled to move laterally against the interior walls of the pipe.

* * * * *